United States Patent [19]

Baker

[11] Patent Number: 4,537,140

[45] Date of Patent: Aug. 27, 1985

[54] AUTOMATIC COAL STOVE STOKER

[76] Inventor: Charles M. Baker, Box 2076, R.D. #2, Orwigsburg, Pa. 17961

[21] Appl. No.: 626,888

[22] Filed: Jul. 2, 1984

[51] Int. Cl.[3] ..... F23N 7/08

[52] U.S. Cl. ..... 110/281; 110/109; 110/282; 110/328; 414/198

[58] Field of Search ..... 110/281, 282, 283, 109, 110/328; 414/198

[56] References Cited

U.S. PATENT DOCUMENTS

| | | | |
|---|---|---|---|
| D. 184,462 | 2/1959 | Shuey . | |
| 701,192 | 5/1902 | Fraser | 110/109 |
| 1,442,295 | 1/1923 | Porter | 110/281 |
| 2,204,555 | 6/1940 | Valentine et al. . | |
| 4,328,786 | 5/1982 | Owen | 110/281 X |

*Primary Examiner*—Edward G. Favors

*Attorney, Agent, or Firm*—Ruth Moyerman

[57] ABSTRACT

An improvement for use in a coal stoker is disclosed. The improvement device is used with a common stoker generally including a hopper operatively connected to and aligned with a base box forming an ash pit. The base box, through its sides sloping downward from the hopper, supports a ramp. The lower part of the ramp is a perforated fire grate while the upper section is a plate that extends through the hopper bottom. A fan effecting a forced draft through the grate is operatively connected to a motor. The improvement comprises a linear reciprocation action carpet that overlies generally the length and width of the plate. The carpet's movement is effected by its connection to the motor. When coal is fed into the hopper and the movable carpet is activated by the motor, the carpet will move in a linear reciprocating direction. The coal falling on the carpet from the hopper will continually advance in an even flow from the carpet's leading edge onto the perforated grate.

14 Claims, 7 Drawing Figures

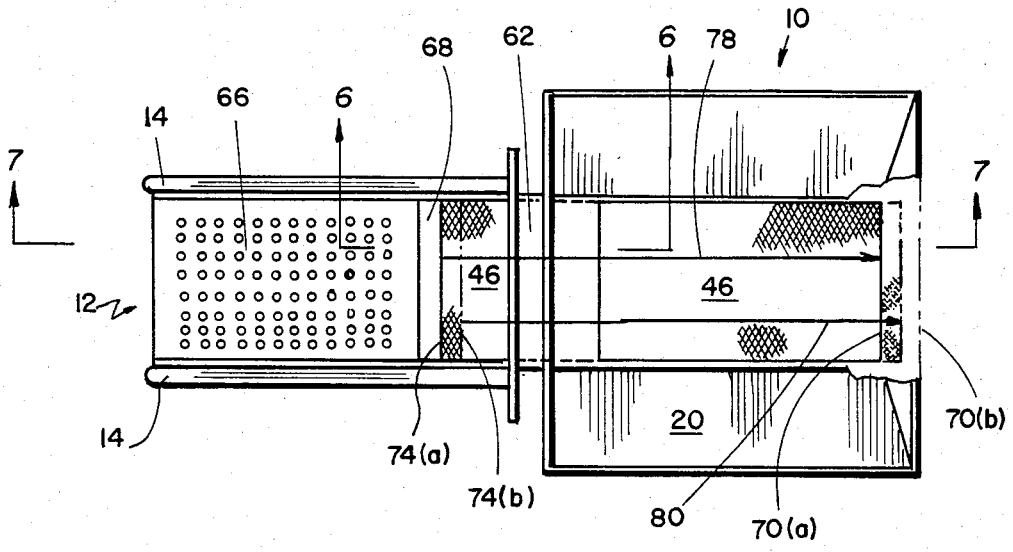
FIG. 3
FIG. 6
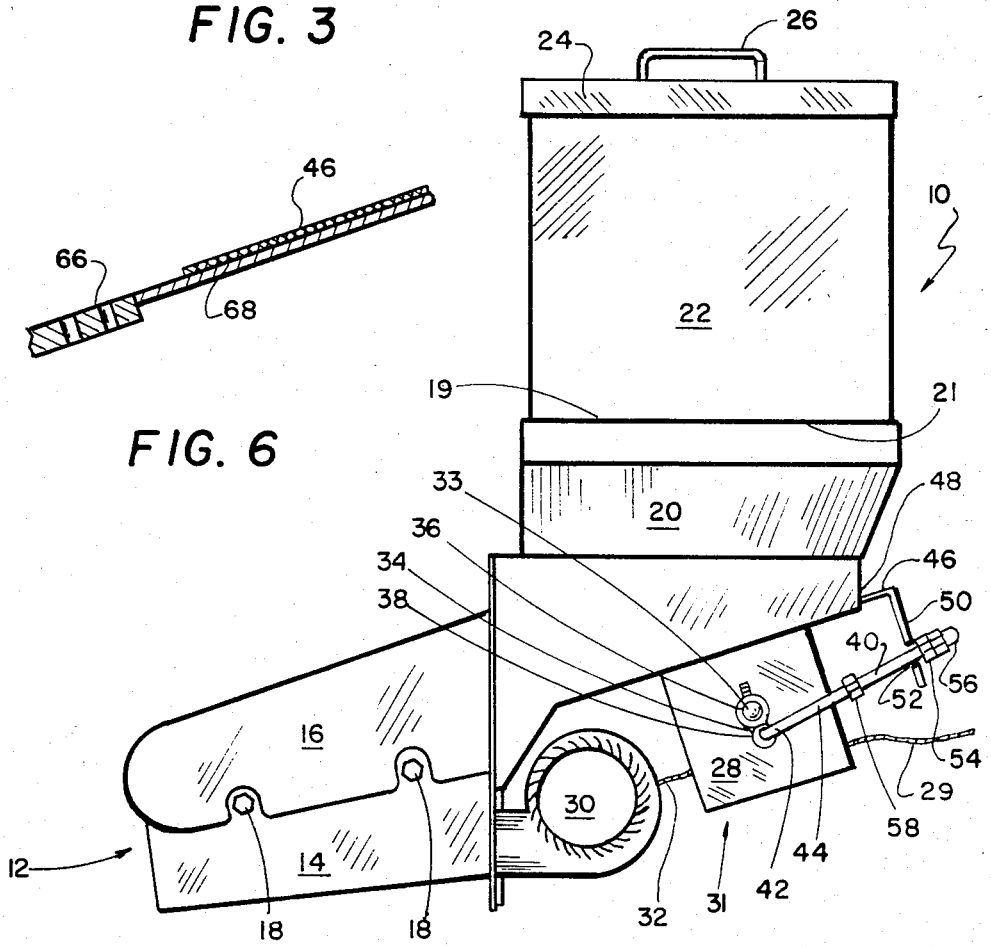
FIG. 1

FIG. 4
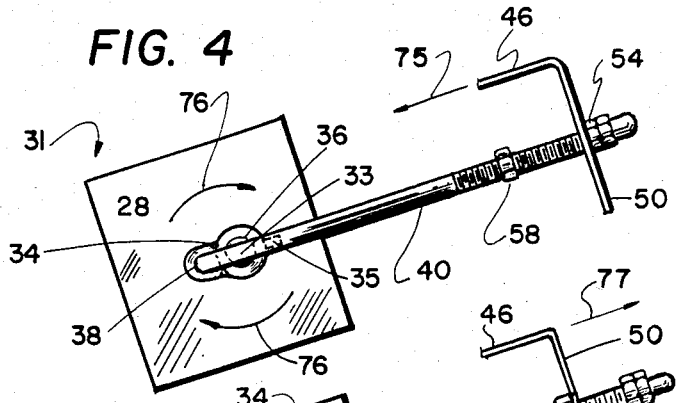
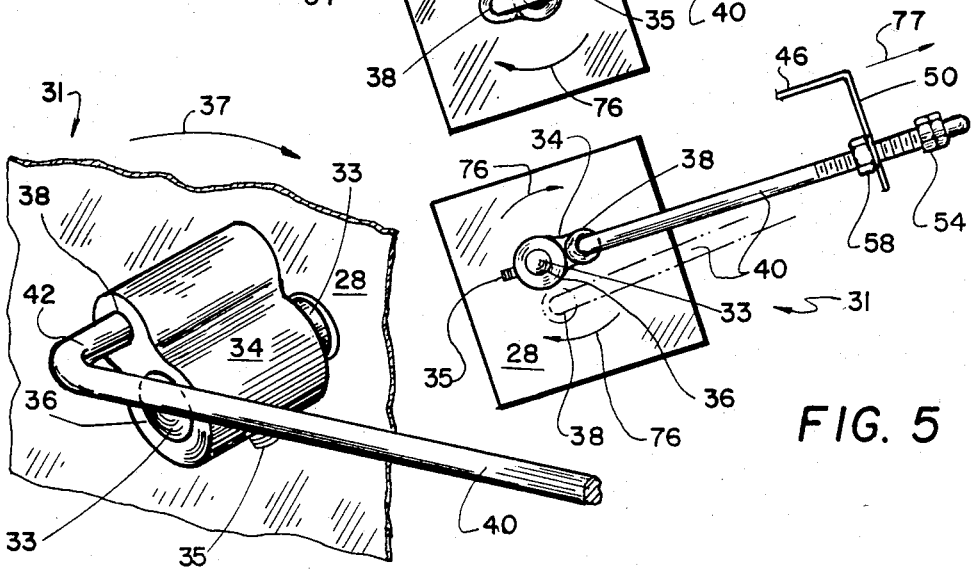
FIG. 5
FIG. 2
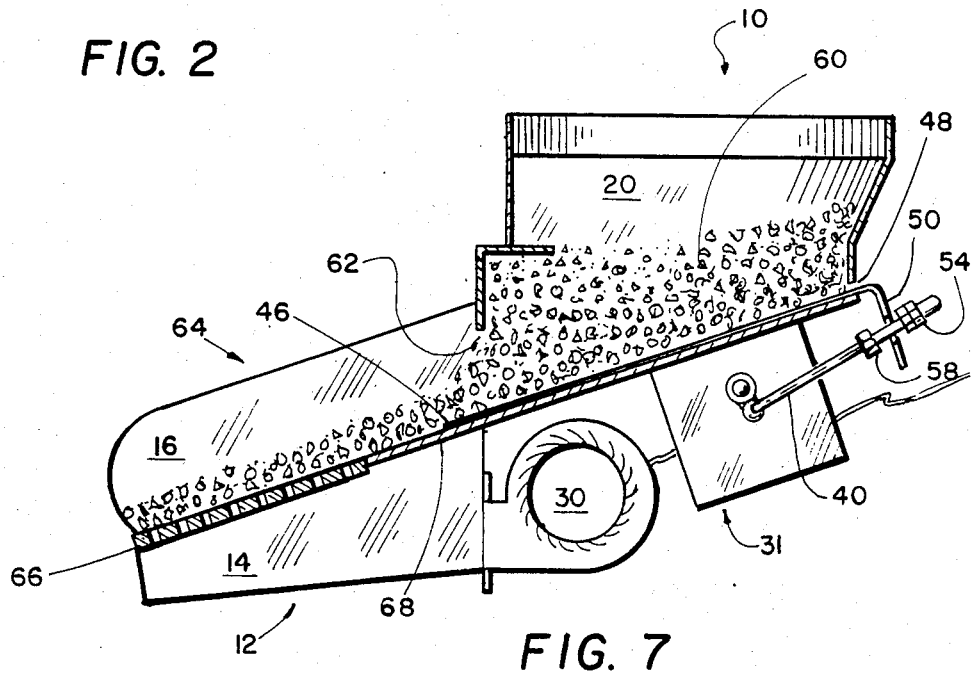
FIG. 7

AUTOMATIC COAL STOVE STOKER

BACKGROUND OF THE INVENTION

1. Field of the Invention

This invention relates to coal stokers, and more particularly to a coal stoker with a movable carpet for advancing fuel in an even flow from the hopper to the fire grate.

2. Description of the Prior Art

Prior art stove stoker devices are known that aid in the movement of fuel, generally coal, from a hopper to a fire grate. However, these devices do not satisfy the need for an even flow of fuel so that near or complete burn out can be accomplished.

U.S. Pat. No. 2,204,555 to Valentine and Hurst and U.S. No. Des. 184,462 to Shuey both disclose a pusher arm or head to advance the coal. The use of such an arm or head prohibits an even flow of fuel as it tends to bunch up the tumbling coal. These aforementioned devices also require the use of a large motor with a speed reduction unit and many more additional mechanical parts.

Although there is a recognized need for an aid to advance the fuel from the hopper onto the fire grate in a small stove, none of these prior art devices advance the fuel in an even flow. There is therefore a need for a stove stoker which eliminates the need for a large motor, speed reduction unit and other various mechanical parts.

There is also a great need for an apparatus that assures an advancement of fuel in an even flow from the hopper to the fire grate with minimum use of mechanical parts.

SUMMARY OF THE DISCLOSURE

The aforementioned prior art problems are overcome by the movable carpet stoker of this invention. The conventional coal stoker intended for use in a stove includes a funnel-shaped hopper with a lower forward passage. An open-topped base box forming an ash pit is attached forward of and aligned with the hopper's lower forward passage. The box includes sides sloping downward from the lower forward passage that support a ramp with corresponding sloping sides. The ramp's bottom also includes a perforated fire grate proximate the lower two-thirds and a plate proximate the higher one-third of the ramp which also extends generally through the hopper's bottom. A fan for effecting a forced draft upwardly through the grate is run by a motor connected to a power source. This apparatus is exemplified by U.S. No. Des. 184,462 to Shuey.

This invention comprises a linear reciprocation action carpet overlying at least generally the length and width of the above-mentioned plate. The carpet is connected preferably by an eccentric movement with a J-rod connector to the motor. When coal is fed into the hopper and the movable carpet is activated by the motor through the eccentric rotation, and stops on the rod's long leg, the carpet moves in a linear reciprocating direction. A further embodiment contemplates a preset pause in the action of the movable carpet at the end of each stroke, preferably produced by having the carpet end in a plate with an aperture through which the rod freely moves between stops. Coal falling from the hopper onto the moving carpet will advance in an even, nontumbling flow from the carpet's leading edge onto the perforated fire grate and effect a more complete burnout.

It is therefore an object of this invention to provide a stoker that aids the gravity flow of coal by use of a sloped, movable carpet.

It is also an object of this invention to provide a device that insures an even flow of coal onto the fire grate for even combustion and burnout.

It is another object of this invention to provide a device that uses a small motor and few mechanical parts.

It is yet another object of this invention to provide a stoker with a linear carpet movement with limits which are easily adjustable.

It is still another object of this invention to provide a device where the coal can be advanced without tumbling over itself.

It is still a further object of this invention to provide a device where the selective positioning of the carpet length always maintains the fire forward of the carpet.

It is finally an object of this invention to provide a device that can be retrofitted into existing wood or coal burning stoves.

These and other objects will be more readily ascertainable to one skilled in the art from a consideration of the following figures, drawing and exemplary embodiment.

BRIEF DESCRIPTION OF THE DRAWING(S)

FIG. 1 is a side view of a preferred embodiment of the apparatus of this invention showing the rod's movement between stops.

FIG. 2 is a fragmentary enlargement of the eccentric movement means connected to the motor and including part of the rod.

FIG. 3 is a top view of the apparatus showing the perforated fire grate and extremes of the movable carpet.

FIGS. 4 and 5 are fragmentary enlargements of the eccentric means showing the rod in each extreme of its stroke as indicated by the stops' relation to the plate.

FIG. 6 is a fragmentary enlargement of the apparatus taken along lines 6—6 of FIG. 3 showing the placement of the fire grate, plate and movable carpet.

FIG. 7 is a partial longitudinal cross section of the apparatus taken along lines 7—7 of FIG. 3 showing the coal flowing over the movable carpet from the hopper onto the fire grate and the rod's movement between stops.

DETAILED DESCRIPTION OF THE PREFERRED EMBODIMENT(S)

Referring now to the drawings and more particularly to FIG. 1, stoker 10 is shown to include base fire box 12, with its sloping side 14, supporting ramp side 16, secured thereto by bolts 18. Hopper 20 is aligned to communicate with fire box 12, more clearly shown in FIG. 7. Funnel-shaped hopper 20 supports and communicates with storage bin 22 through hopper 20's open top at 19 and storage bin 22's open bottom at 21. Storage bin 22 includes removable top 24 with its handle 26.

Movable carpet 46, extending through hopper 20's rearward transverse slit at 48, includes attached perpendicular plate 50 with its aperture 52. Plate 50 projects downward to the rear of hopper 20.

Motor 28 is operatively connected to an outside power source (not shown) by wires 29 and to impeller fan 30 by wires 32. Motor 28 is also operatively connected to eccentric movement means 31 by motor shaft 33 fitting into housing 34's sleeve 36. Second sleeve 38 receives rod 40's short leg 42. Rod 40's longer leg 44 is fitted through perpendicular plate 50's aperture 52 and terminates at nut 56 as may be seen in better detail in subsequent figures.

Stop 54 is at rod 40's long end 56 and stop 58 is at a predetermined point on rod 40's longer leg 44 so that when rod 40's clockwise stroke engages stops 54 and 58 with plate 50, there is a linear reciprocating movement of carpet 46. The movement of rod 40 between stops 54 and 58, as is shown in this figure, causes a pause of carpet 46's movement for the duration of rod 40's movement between stops 54 and 58. The action of movable carpet 46 as it relates to eccentric movement means 31 will be explained in more detail with reference to FIGS. 4 and 5.

Referring now to FIG. 2, a fragmentary enlargement of the eccentric movement is shown including eccentric movement means 31 being shown operatively connected to motor 28. Motor shaft 33 fits through sleeve 36 of housing 34 and is secured thereto by set screw 35. Rod 40's short leg 42 fits into second sleeve 38 of housing 34. A clockwise movement of rod 40 around motor shaft 33, as shown by arrow 37, results when motor 28 is activated by an outside power source.

Referring now to FIG. 3, a top view of stoker 10 is shown with fire grate 66 and its relation to the two forward extremes of movable carpet 46 as indicated by 74 (*a* and *b*), and backward extremes (shown in cutaway) of movable carpet 46 as indicated by 70 (*a* and *b*). Achievement of this movement will be more fully explained with reference to FIGS. 4 and 5. Plate 68 separates fire grate 66 from movable carpet 46.

As shown in FIGS. 4 and 5, when motor 28 is activated by its power source (not shown), it will cause motor shaft 33, locked into first sleeve 36 by set screw 35 (shown in phantom in FIG. 4), to turn housing 34 in a clockwise direction as indicated by arrows 76. Thus, rod 40, secured into second sleeve 38, will also rotate in a clockwise direction engaging, at various times within the stroke, stops 54 and 58 which, in turn, push and pull plate 50, thereby effecting the linear reciprocating movement of carpet 46. The movement of rod 40 between stops 54 and 58 causes a pause of carpet 46's movement for the duration of rod 40's movement between stops 54 and 58. Stops 54 and 58, in a carpet pause position, are shown in FIGS. 1 and 7.

Referring now to FIG. 4 particularly, a fragmentary enlargement shows eccentric movement means 31 having pulled movable carpet 46 in the direction of arrow 75. The clockwise rotation of rod 40 has engaged stop 54 with plate 50 so that stop 54 has pulled movable carpet 46 (as indicated by arrow 75) to the nearest extreme it will reach towards the perforated fire grate. As shown in FIG. 3, this means movable carpet 46 now spans the space between 70*a* and 74*a* as indicated by arrow 78 and is at its nearest extreme to fire grate 66.

Referring now particularly to FIG. 5, a fragmentary enlargement shows eccentric movement means 31 having pushed movable carpet 46 in the direction of arrow 77. Clockwise rotation of rod 40 has now engaged stop 58 with plate 50 so that stop 58 has pushed movable carpet 46 (as indicated by arrow 77) to the furthest extreme it will reach from the perforated fire grate. As shown in FIG. 3, movable carpet 46, in this position, spans the space between 74*b* and 70*b* as indicated by arrow 80, and is at its furthest extreme away from fire grate 66. Continued clockwise rotation of rod 40 is shown in phantom. All extremes just illustrated are adjustable through the movement of stops 54 and/or 58 over threaded rod 40.

As shown in FIG. 3, the linear reciprocating movement of carpet 46 advances coal from hopper 20, through hopper 20's forward passage inlet at 62, along movement carpet 46 in an even flow, onto perforated grate 66 to enhance a more complete or near burn out. Perforated grate 66 is supported by fire box 12 and sides 14.

Now referring to FIG. 6, a fragmentary enlargement taken on lines 6—6 of FIG. 3 is shown to more clearly depict the placement of fire grate 66, plate 68 and movable carpet 46 in a downward slope. Movable carpet 46, in the same downward slope as plate 68, overlies plate 68 and terminates forwardly short of fire grate 66. Fire grate 66 abutts plate 68 and continues in the same downward slope to effect the gravity flow of coal enhanced by movable carpet 46. This movement will be more fully discussed with reference to FIG. 7.

Referring now to FIG. 7, a partial longitudinal cross section of stoker 10 taken along lines 7—7 of FIG. 3 is shown with rod 40's movement between stops 54 and 58, thereby effecting a pause in movement of movable carpet 46.

Ramp 64 is illustrated to include perforated grate 66, plate 68 (which extends generally through hopper 20's bottom), and sloping side 16. Ramp 64 is supported by side 14 of fire box 12. Movable carpet 46, lying generally over plate 68 and extending through transverse slit 48, is operatively connected to eccentric movement means 31 through perpendicular plate 50.

Coal 60 advances from hopper 20, through hopper 20's lower forward passage 62, on movable carpet 46, in an even flow until it reaches perforated grate 66. The action of movable carpet 46, through its connection to eccentric movement means 31 by plate 50 (previously discussed in FIGS. 3, 4 and 5), enhances the gravity flow of coal 60 and advances coal 60 in an even flow onto fire grate 66. With forced draft of impeller fan 30, near or complete burn out is accomplished.

There are many variations which may be practiced within the scope of this invention. For example, an electrical switch may be employed to turn the power source on and off and still be within the scope of the invention.

The means by which the carpet is reciprocally moved is not critical and would still be within the scope of the invention so long as it continues to effect an even flow of fuel onto the fire grate.

Likewise, the threaded rod is merely a suggestion as a means for adjusting the stops. Any means for adjusting the stops would still be within the scope of the invention.

The additional storage bin is not critical and is merely suggested as a matter of convenience.

The overall dimensions of the stoker are not critical. While the stoker is primarily for use in a home stove, it could be adapted for use in a home or commercial furnace and still be within the scope of the invention.

The manner or method used to effect the force draft and power to the movable carpet, as long as it accomplishes the task, can be of any means and still be within the scope of the invention.

The length of the carpet is not critical as long as the carpet extends towards the grate beyond the hopper's lower forward passage.

The device of this invention has many advantages. Chiefly among these is the movable carpet that aids the gravity flow of fuel and provides an even flow of fuel from the hopper onto the grate in uniform thickness for a more complete burn out.

Secondly, the device requires the use of only a small motor and has few moving parts.

Third, the length of the carpet action can be easily changed by the simple adjustment of the stops.

Fourth, the stoker can be easily retrofitted into existing coal or wood burning stoves.

Fifth, the near complete burn out effected by use of the device requires little ash removal.

Sixth, the stoker is easily portable when used with room stoves.

Finally, while the device is generally meant to be used with a room stove, its usage is also applicable with a home furnace or larger industrial application.

Having now illustrated and described my invention, it is not intended that such description limit the invention, but that the invention be limited only by a reasonable interpretation of the appended Claims.

What is claimed is:

1. In a coal stoker including a hopper with a lower forward passage, a base box forming an ash pit, a ramp, said ramp including a fire grate proximate the lower two-thirds of said ramp and a plate proximate the higher one-third of said ramp with the plate extending generally through said hopper's bottom and a motor including a shaft, the improvement comprising:

(a) a linear reciprocating carpet overlying at least generally the length and width of said plate; said carpet operatively connected to said motor by eccentric movement means, said means including:
  (i) a housing including two aligned sleeves, one said sleeve overfitting said motor shaft, said housing's second sleeve adapted to receive
  (ii) one end of a J-shaped rod, said rod's other end being operatively connected to said movable carpet, so that when said motor is activated by said power source, said motor shaft's 360 degree revolution causes said second sleeve to rotate, thereby moving said rod in its stroke so that coal falling on said carpet from said hopper will continually advance from said carpet's leading edge onto said grate in an even flow.

2. The coal stoker according to claim 1 wherein said hopper also includes a transverse rearward lower slit aligned with said movable carpet and wherein said carpet in reciprocating extends through said hopper's lower rearward slit and wherein said stoker comprises additionally a plate, said plate attached perpendicular to said carpet at said carpet's rear edge, said plate projecting downward to the rear of said hopper and including an aperture to receive therethrough said rod.

3. The coal stoker according to claim 2 wherein said short leg of said rod is the rod end received by said housing's second sleeve, said longer leg's end being adapted to slidably fit through said plate's aperture, said stoker also comprising additionally two stops, one stop at said rod's long end and the other at a predetermined point on said longer rod so that when said motor is activated by said power source, said rod's stroke engages said stops with said perpendicular plate, thereby effecting said linear reciprocating movement of said carpet and the movement of said rod between said stops causes a pause of said carpet's movement for the duration of said rod's movement between said stops.

4. The coal stoker according to claim 3 wherein said stops are adjustable through said threaded rod.

5. A coal stoker according to claim 1 wherein said stoker includes an open bottom and open top storage bin communicating with said hopper's top.

6. A storage bin according to claim 5 wherein said bin includes a removable top.

7. A storage bin according to claim 6 wherein said bin's removable top includes handle means.

8. The coal stoker according to claim 1 wherein said means for effecting a forced draft is an impeller fan.

9. The coal stoker according to claim 1 wherein said motor is an electric motor.

10. A motorized coal stoker comprising:

(a) a ramp, said ramp including a rearward plate to receive coal and a forward fire grate;

(b) a linear reciprocating carpet overlying generally the length and width of said plate; and, (c) eccentric movement means operably connected to said carpet means, said means including:
  (i) a housing including two apertures, one aperture receiving the shaft of said motor and the other aperture receiving one end of
  (ii) a J-shaped rod, said rod's other end being operatively connected to said carpet.

11. The coal stoker according to claim 10 wherein said housing comprises a pair of parallel sleeves.

12. The coal stoker according to claim 10 wherein said carpet connection to said rod comprises an apertured plate attached generally perpendicular to said carpet at said carpet's rear edge, said plate projecting downward to receive therethrough said rod.

13. The coal stoker according to claim 12 wherein said rod is threaded.

14. In a coal stoker intended for use in a stove including an open-topped, generally funnel-shaped hopper with a lower forward passage, a rear wall and an open-topped base box forming an ash pit attached forward of and aligned with said hopper's lower forward passage, said box including sides sloping downward from said hopper's lower forward passage, said base box sides supporting thereon a ramp with corresponding sloping sides, said ramp comprising a perforated fire grate proximate the lower two-thirds of said ramp and a plate proximate the higher one-third of said ramp, said plate extending generally through said hopper's bottom, means for effecting a forced draft upwardly through said grate and a motor including a shaft operatively connected to said means for effecting said draft, the improvement comprising:

(a) a linear reciprocating carpet operatively connected to said motor, said carpet overlying at least generally the length and width of said plate;

(b) a transverse rearward slit located in said hopper's rear wall and aligned with said movable carpet so that said carpet, in reciprocating, extends through said rearward slit;

(c) a plate, said plate attached perpendicular at its edge to said carpet at said carpet's rear edge and projecting downward at the rear of said hopper, said plate including an aperture; and, (d) an eccentric movement means including:
  (i) a housing including two aligned apertures, one said aperture adapted to overfit said motor shaft, said housing's second aperture adapted to receive therethrough (ii) a generally J-shaped rod, said rod's short leg end received by said housing's second sleeve, said rod's longer leg end being operatively connected to said carpet through said plate's aperture; and, (iii) two adjustable stops, one said stop at said rod's longer leg end and the other said stop at a predetermined point on said longer leg so that when said motor is activated by said power source, said motor shaft's 360 degree revolution causes said second sleeve to also rotate, thereby moving said rod in its stroke until said rod's stroke causes said plate to engage said stops, thereby effecting said linear reciprocating movement of said carpet while the movement of said rod between said stops causes a pause of said carpet's movement for the duration of said rod's movement, whereby coal falling on said carpet from said hopper will continually advance from said carpet's leading edge onto said perforated grate in an even flow.

* * * * *

UNITED STATES PATENT AND TRADEMARK OFFICE

CERTIFICATE OF CORRECTION

PATENT NO. : 4,537,140

DATED : August 27, 1985

INVENTOR(S) : CHARLES M. BAKER

It is certified that error appears in the above-identified patent and that said Letters Patent are hereby corrected as shown below:

Claim 13, line 35 - delete the number "13" and substitute therefor the number "4".

Claim 13, line 35 - delete the number "12" and substitute therefor the number "3".

Claim 8, line 12 - delete the number "8" and substitute therefor the number "14".

Claim 8, line 12 - delete the number "1" and substitute therefor the number "13".

Claim 4, line 3 - delete the number "4" and substitute therefor the number "5".

Claim 4, line 3 - delete the number "3" and substitute therefor the number "4".

Claim 5, line 5 - delete the number "5" and substitute therefor the number "6".

Claim 6, line 8 - delete the number "6" and substitute therefor the number "7".

Claim 6, line 8 - delete the words "A storage bin" and substitute therefor the words "The coal stoker"

Claim 6, line 8 - delete the number "5" and substitute therefor the number "6".

Claim 7, line 10 - delete the number "7" and substitute therefor the number "8".

UNITED STATES PATENT AND TRADEMARK OFFICE

CERTIFICATE OF CORRECTION

PATENT NO. : 4,537,140

DATED : August 27, 1985

INVENTOR(S) : CHARLES M. BAKER

It is certified that error appears in the above-identified patent and that said Letters Patent are hereby corrected as shown below:

Claim 7, line 10 - delete the words "A storage bin" and substitute therefor the words "The coal stoker".

Claim 7, line 10 - delete the number "6" and substitute therefor the number "7".

Claim 14, line 37 - delete the number "14" and substitute therefor the number "13".

Signed and Sealed this

Eighteenth Day of November, 1986

*Attest:*

DONALD J. QUIGG

*Attesting Officer* *Commissioner of Patents and Trademarks*